US009624007B2

(12) United States Patent
Lai et al.

(10) Patent No.: US 9,624,007 B2
(45) Date of Patent: Apr. 18, 2017

(54) METHOD OF MANUFACTURING EXTERNAL COVER EDGE OF MOLDED CUP LID AND PRODUCT MANUFACTURED BY THE SAME

(71) Applicant: Dandong Mingcheng Environmental Protection Products Co., Ltd., Dandong, Liaoning Province (CN)

(72) Inventors: Zongshen Lai, Yilan (CN); Jianfeng Chen, Shaoguan (CN)

(73) Assignee: Dandong Mingcheng Environmental Protection Products Co., Ltd., Dandong (CN)

( * ) Notice: Subject to any disclaimer, the term of this patent is extended or adjusted under 35 U.S.C. 154(b) by 0 days.

(21) Appl. No.: 14/427,007

(22) PCT Filed: Apr. 15, 2014

(86) PCT No.: PCT/CN2014/000413

§ 371 (c)(1),
(2) Date: Mar. 10, 2015

(87) PCT Pub. No.: WO2015/157877

PCT Pub. Date: Oct. 22, 2015

(65) Prior Publication Data

US 2017/0021979 A1 Jan. 26, 2017

(51) Int. Cl.
*B65D 43/02* (2006.01)
*D21J 3/00* (2006.01)

(52) U.S. Cl.
CPC ..... *B65D 43/0212* (2013.01); *B65D 43/0222* (2013.01); *D21J 3/00* (2013.01); *B65D 2543/00268* (2013.01); *B65D 2543/00351* (2013.01); *B65D 2543/00731* (2013.01); *B65D 2543/00833* (2013.01)

(58) Field of Classification Search
CPC B65D 39/16; B65D 43/0212; B65D 43/0204; B65D 43/0202; B65D 43/02; B65D 41/0485; B65D 45/32; B65D 45/322; D21J 3/00; B29C 47/54; B29C 55/30
USPC ..... 220/319, 315, 793, 805; 229/404, 400; 215/275, 274, 273, 305, 295; 264/323, 264/310, 319
See application file for complete search history.

(56) References Cited

U.S. PATENT DOCUMENTS 1,494,362 A * 5/1924 Louisot ..... D21J 3/00 162/228
1,864,919 A * 6/1932 Martlin ..... D21J 3/00 162/277

(Continued)

FOREIGN PATENT DOCUMENTS

CN 201240029 Y 5/2009
CN 101961921 A 2/2011

(Continued)

*Primary Examiner* — Robert J Hicks
(74) *Attorney, Agent, or Firm* — Alan D. Kamrath; Kamrath IP Lawfirm, P.A.

(57) ABSTRACT

A method of manufacturing an external cover edge of a molded cup lid and a product manufactured by the method includes an intermediate product of the molded cup lid made of plant fiber and manufactured by both "pulp suction shaping" and "thermal compression shaping" processes. A protruding-out outer cover edge is formed around the periphery of the intermediate product.

6 Claims, 6 Drawing Sheets

(56) References Cited

U.S. PATENT DOCUMENTS

| | | | | | |
|---|---|---|---|---|---|
| 2,071,340 | A | * | 2/1937 | Hothersall | B31B 43/00<br>264/323 |
| 2,203,343 | A | * | 6/1940 | Stack | D21J 3/00<br>162/392 |
| 2,313,628 | A | * | 3/1943 | De Villers | A42C 3/00<br>223/7 |

FOREIGN PATENT DOCUMENTS

| | | | | | |
|---|---|---|---|---|---|
| CN | 203583290 | U | | 5/2014 | |
| GB | 528582 | A | * | 11/1940 | D21J 3/00 |
| JP | H08156955 | A | | 6/1996 | |
| TW | 201103828 | A | | 2/2011 | |

* cited by examiner

METHOD OF MANUFACTURING EXTERNAL COVER EDGE OF MOLDED CUP LID AND PRODUCT MANUFACTURED BY THE SAME

BACKGROUND OF THE INVENTION

Field of the Invention

The present invention relates to a method of manufacturing an external cover edge of a molded cup lid and a product manufactured by the method and, more particularly to the product made of plant fibers and the manufacturing method that adopts two techniques, respectively: "pulp suction shaping" and "thermal compression shaping" to produce an intermediate product of the molded cup lid, then forms a protruding-out outer cover edge around the periphery of the intermediate product, and finally produces the molded cup lid product.

Description of the Related Art

In general, a conventional disposable cup lid is made of a plastic material, such as polypropylene (PP), polystyrene (PS), and polyvinyl chloride (PVC), and is manufactured by plastic injection molding. Such cup lid is commonly known as "plastic cup lid". As to recycling and disposal, the conventional plastic cup lid causes a serious pollution issue. Particularly, when the quantity is large, the recycling process is difficult, and the plastic cup lid leads to serious damage to the environment. The disposable cup lid made of plastic totally departs from the concept of environmental protection. Since the conventional plastic cup lid is manufactured by plastic injection molding, the moving space required for demolding is limited, so that the plastic cup lid product fails to meet the requirement of covering the mouth of the paper cup closely. After the lid is combined with the mouth of the paper cup, the lid may be loosened or separated from the mouth of the paper cup to cause a leakage of the beverage contained in the paper cup and to raise a safety concern.

At present, mixtures such as pulp and plant fiber are used as materials to make cup lids, and the cup lids are manufactured by molds through the pulp suction shaping and thermal compression shaping technologies, and such cup lid is called "molded cup lid" or "paper cup lid", which has a significantly different terminology with respect to the plastic cup lid. Therefore, the terms "molded cup lid' and "paper cup lid" mentioned in the present invention refer to the objects with the same properties. To meet the requirements of covering the molded cup lid product onto the mouth of the paper cup and preventing leakage of the beverage, the ideal relative covering relation between the molded cup lid 10 and the paper cup body 20 is shown in FIGS. 1 and 2. The molded cup lid 10 has a top ring portion 11, whose internal periphery may be designed with a height drop to enhance the strength of the cover portion 111. The outer side of the top ring portion 11 is descended gradually from an outer arc edge 112 and slightly expanded outward to form a peripheral portion 12, then extended outward when reaching an inner arc edge 121, further covered downwardly and inwardly to form an outer cover edge 13 with the lowest point extended inwardly to form an inverted-hook groove 14, and then outwardly deviated to form a lift wall 15. The paper cup body 20 has a covered ring 21 with an expanded external diameter formed at the mouth of the cup, and a concave annular ring groove 22 formed at a joint of the bottom of the covered ring 21 and the paper cup body 20. During use, the molded cup lid 10 is covered onto the mouth of the paper cup body 20. At first, the molded cup lid 10 cannot be covered onto the mouth of the paper cup body 20 completely. Thus, it is necessary to apply a force to cover the outer cover edge 13 at a side of the molded cup lid 10 onto the covered ring 21 at the corresponsive position of the paper cup body 20 as much as possible, and then further apply a force to slightly, rotate the remaining outer cover edge 13 outward to force it to pass the remaining covered ring 21, so that the outer cover edge 13 totally encloses the covered ring 21 tightly, so that and the inverted-hook groove 14 of the molded cup lid 10 is pressed precisely into the concave annular ring groove 22 at the bottom of the covered ring 21 to enhance the covering stability between the outer cover edge 13 and the covered ring 21.

In FIGS. 1 and 2, the molded cup lid 10 has the double structure of the outer cover edge 13 and the inverted-hook groove 14, which is an important factor for covering the molded cup lid 10 onto the paper cup body 20 tightly. In actual manufacture, the inverted-hook groove 14 of the molded cup lid 10 cannot be formed directly, and it is necessary to form an intermediate product 100 of the molded cup lid as shown in FIG. 3 first. In other words, the intermediate product 100 is a general molded product processed by the "pulp suction shaping" and "thermal compression shaping" processes. Now, the intermediate product 100 has the top ring portion 11, the cover portion 111, the outer arc edge 112, the peripheral portion 12, the inner arc edge 121 and the lift wall 15, and a partially formed outer cover edge 13, but without the existence of the inverted-hook groove 14. The reason resides on that the limitation of the moving space required for demolding the intermediate product 100 after the "thermal compression shaping" process takes place, so that the lower section of the outer cover edge 13 cannot be formed inwardly in a negative angle. Therefore, it is necessary to perform the shaping vertically in the up and down status first. As a result, the intermediate product 100 as shown in FIG. 3 is formed first, and, then, the intermediate product 100 is processed with a compression and deformation process before the lower section of the outer cover edge 13 can be shaped inwardly with a negative angle, to form the structure of the inverted-hook groove 14.

With reference to FIGS. 4 and 5 for the compression and deformation process of a conventional intermediate product 100, an outer mold 30 is covered onto the intermediate product 100. The outer mold 30 is configured to be corresponsive to a side profile of the intermediate product 100, and a transverse annular side groove 311 is formed at a position of the outer mold 30 where the inverted-hook groove 14 is formed on the intermediate product 100 for receiving a group of shaping slide blocks 32. The internal periphery of the shaping slide blocks 32 has a protruding-out shaping ridge 321, such that when the shaping ridges 321 are moved forward and inward together, all of the shaping ridges 321 can be conjoined into an annular body. An inner mold 33 is received into the intermediate product 100. A material-propping block 34 is contained in the middle of the inner mold 33, and the material-propping block 34 has a profile corresponsive to the intermediate product 100. However, the inner mold 33 has a recessed receiving groove 331 formed at a position of the intermediate product 100 where the inverted-hook groove 14 is formed, and the location and profile of the recessed receiving groove 331 correspondingly match with those of the shaping ridge 321. When the molds of the outer mold 30 and the inner mold 33 together with the material-propping block 34 are closed as shown in FIG. 4 and the shaping slide blocks 32 are pushed to move inward, the shaping ridges 321 abut the outer surface of the intermediate product 100, and move forward continuously to let the shaping ridge 321 resist the surface of the intermediate product 100 and be deformed and contracted into the receiving groove 331 of the inner mold 33. Therefore, an annular inverted-hook groove 14 is formed on the intermediate product 100 as shown in FIG. 5, and the lower section of the outer cover edge 13 produces a negative angle inwardly, to form a product of the molded cup lid 10. Then, the shaping slide blocks 32 are withdrawn outward, and the outer mold 30 and the inner mold 33 are opened in a direction opposite to the closing direction. The material-propping block 34 props the molded cup lid 10 out to complete the whole process.

Although the manufacturing process as shown in FIGS. 4 and 5 completes the manufacture of the molded cup lid 10, the molded cup lid 10 so manufactured still has the following drawbacks. Since the intermediate product 100 is formed by using the "pulp suction shaping" and "thermal compression shaping" processes, the shape and profile are fixed. The inverted-hook groove 14 formed on the stably shaped intermediate product 100 is manufactured by compression, and the inverted-hook groove 14 is situated at an unstably formed position of the molded cup lid 10, so that a slight natural withdrawal (in the direction opposite to the compression) is formed at the inverted-hook groove 14 and the lower portion of the outer cover edge 13 due to the effect of the plastic material while the cup sits still as shown in FIG. 6. Since the withdrawal is very small, the appearance does not show, but when the molded cup lid 10 is used to cover onto the mouth of the paper cup body 20, the following effects of forces will be confronted:

1. It is necessary to apply a force for the operation, so that the molded cup lid 10 is rotated and expanded slightly outward, and so that the compulsory restoration goes beyond the covered ring 21 of the paper cup body 20. Since the direction of applying the force is opposite to the deformation direction of the inverted-hook groove 14, therefore the inverted-hook groove 14 will be withdrawn in a direction opposite to the direction of compression.

2. Since the paper cup body 20 is generally used for containing a hot beverage, heat is transmitted upwardly and outwardly, so that the inverted-hook groove 14 will also be withdrawn in a direction opposite to the direction of compression.

3. The inverted-hook groove 14 and the lower section of the outer cover edge 13 of the molded cup lid 10 are withdrawn naturally. Thus, the beverage contained in the paper cup body 20 may leak easily after the molded cup lid 10 is covered onto the mouth of the paper cup due to the joint effect of the withdrawals by force and heat, or the molded cup lid 10 may be loosened or separated from the paper cup body 20. Such conventional design fails to meet the requirement of covering the molded cup lid 10 onto the paper cup body 20 tightly or to prevent hot beverage from leaking out from the paper cup.

SUMMARY OF THE INVENTION

In view of the aforementioned drawbacks of the prior art, the method of manufacturing an external cover edge of a molded cup lid in accordance with the present invention overcomes the drawbacks of the prior art.

Therefore, it is a primary objective of the present invention to provide a manufacturing method for producing an intermediate product of a molded cup lid made of a plant fiber and processed by the "pulp suction shaping" and "thermal compression shaping" processes, with a protruding-out outer cover edge formed around the periphery of the molded cup lid.

Another objective of the present invention is to provide molded cup lid product made of a plant fiber and processed by the "pulp suction shaping" and "thermal compression shaping" processes, with a protruding-out outer cover edge formed around the periphery of the molded cup lid.

To achieve the aforementioned and other objectives, the present invention provides a method of manufacturing an external cover edge of a molded cup lid, with an intermediate product of the molded cup lid made of a plant fiber material and manufactured by a "pulp suction shaping" process and a "thermal compression shaping" process. The method comprises the following steps:

(1) Cover an outer mold onto the intermediate product. The outer mold has a side profile matching the intermediate product. The outer mold includes a plurality of slide blocks disposed at a position of the intermediate product where the outer cover edge is formed, and the slide blocks are pushed forward to form an annular body. A receiving groove is formed on an inner edge of the slide block and has a profile corresponsive to the outer cover edge for moving the slide blocks forward, to make the receiving groove reach an outer surface of the intermediate product at a position where the outer cover edge is formed.

(2) Install an inner mold into the intermediate product. The inner mold has a profile matching the profile of the intermediate product. A transversally movable shaping mold is installed in the middle of the inner mold, and the shaping mold has a front end formed into a shaping ridge corresponsive to profile of the pre-formed outer cover edge. An external power is installed at a rear end of the shaping mold for driving the shaping mold to move forward or backward, such that the external power may push the shaping mold to move forward to an inner surface of the intermediate product at a position where the outer cover edge is pre-formed.

(3) Push the shaping mold to move continuously forward by the external power. The surface of the intermediate product is compressed by the shaping ridge and deformed to form the profile of the outer cover edge that enters and remains in the receiving groove.

(4) Produce relative rotation between the inner mold and the shaping mold jointly with the outer mold, the slide block and the intermediate product. The shaping ridge of the shaping mold is compressed at the inner surface of the intermediate product to form an outer cover edge that enters and remains in the receiving groove.

(5) Withdraw the shaping mold to its original position by the external power. While withdrawing the slide block outward, open the outer mold and the inner mold to produce the molded cup lid.

In the method of manufacturing an external cover edge of a molded cup lid, the intermediate product of the molded cup lid has a top ring portion with an outer side descended from an outer arc edge and expanded outwardly into a peripheral portion, and extended outwardly after reaching an inner arc edge. An inverted-hook groove is formed at a position vertically below a starting-point position of a not-yet formed outer cover edge, deviated outwardly and formed into a lift wall.

In the method of manufacturing an external cover edge of a molded cup lid, when the slide block is moving forward and the receiving groove reaches the outer surface of the intermediate product at a position where the outer cover edge is pre-formed, the top of the receiving groove abuts the starting-point position of the not-yet formed outer cover edge, and the bottom of the receiving groove abuts the inverted-hook groove.

The present invention also provides a molded cup lid product manufactured by the aforementioned method, with an intermediate product of the molded cup lid made of a plant fiber material manufactured by a pulp suction shaping process and a thermal compression shaping process. The method of manufacturing the intermediate product of the molded cup lid comprises the steps of:

(1) Cover an outer mold onto the intermediate product. The outer mold has a side profile matching the intermediate product. The outer mold includes a plurality of slide blocks disposed at a position of the intermediate product where the outer cover edge is formed, and the slide blocks are pushed forward to form an annular body. A receiving groove is formed on an inner edge of the slide block and has a profile corresponsive to the outer cover edge for moving the slide blocks forward, to make the receiving groove reach an outer surface of the intermediate product at a position where the outer cover edge is formed.

(2) Install an inner mold into the intermediate product. The inner mold has a profile matching the profile of the intermediate product. A transversally movable shaping mold is installed in the middle of the inner mold, and the shaping mold has a front end formed into a shaping ridge corresponsive to profile of the pre-formed outer cover edge. An external power is installed at a rear end of the shaping mold for driving the shaping mold to move forward or backward, such that the external power may push the shaping mold to move forward to an inner surface of the intermediate product at a position where the outer cover edge is pre-formed.

(3) Push the shaping mold to move continuously forward by the external power. The surface of the intermediate product is compressed by the shaping ridge and deformed to form the profile of the outer cover edge that enters and remains in the receiving groove.

(4) Produce relative rotation between the inner mold and the shaping mold jointly with the outer mold, the slide block and the intermediate product. The shaping ridge of the shaping mold is compressed at the inner surface of the intermediate product to form an outer cover edge that enters and remains in the receiving groove.

(5) Withdraw the shaping mold to its original position by the external power. While withdrawing the slide block outward, open the outer mold and the inner mold to produce the molded cup lid.

In the molded cup lid product, the intermediate product of the molded cup lid has a top ring portion with an outer side descended from an outer arc edge and expanded outwardly into a peripheral portion, and extended outwardly after reaching an inner arc edge. An inverted-hook groove is formed at a position vertically below a starting-point position of a not-yet formed outer cover edge, and deviated outwardly and formed into a lift wall.

In the molded cup lid product, when the slide block is moving forward, and the receiving groove reaches the outer surface of the intermediate product at a position where the outer cover edge is pre-formed, the top of the receiving groove abuts the starting-point position of the not-yet formed outer cover edge, and the bottom of the receiving groove abuts the inverted-hook groove.

DETAILED DESCRIPTION OF THE PREFERRED EMBODIMENTS

The technical characteristics, contents, advantages and effects of the present invention will be apparent with the detailed description of preferred embodiments accompanied with related drawings as follows.

The present invention discloses a method of manufacturing an external cover edge of a molded cup lid and a product manufactured by the method. An intermediate product of the molded cup lid is made of a plant fiber material and manufactured by a "pulp suction shaping" process and a "thermal compression shaping" process. A protruding-out outer cover edge is formed around the periphery of the intermediate product. The invention also provides a molded cup lid product manufactured by the aforementioned method. Since both pulp suction shaping and thermal compression shaping processes of the plant fiber materials are prior art, they will not be described here.

Figure 1:
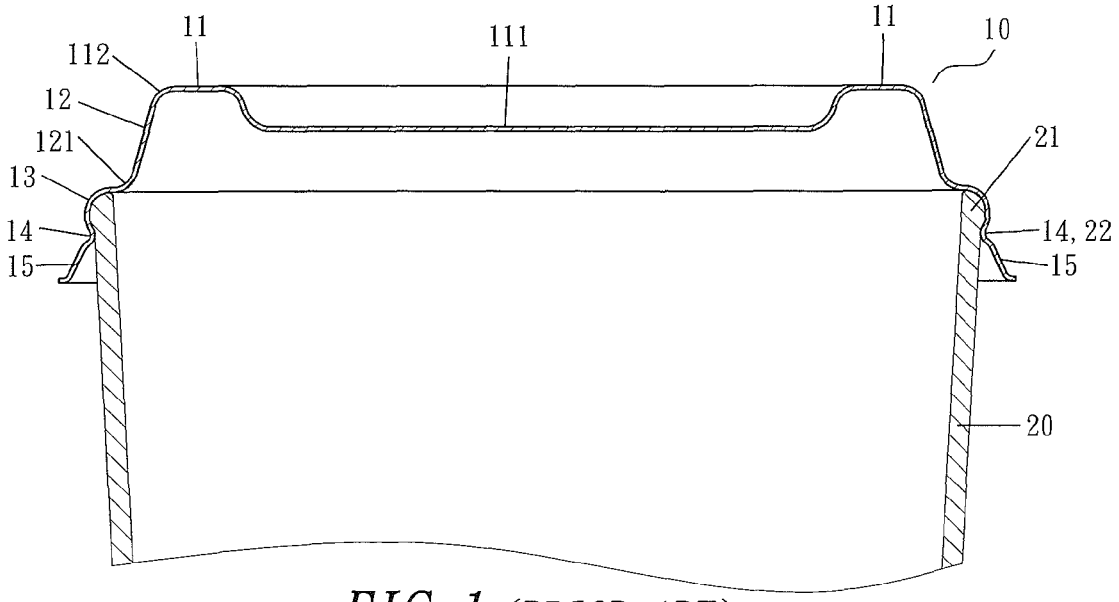
FIG. 1 (PRIOR ART)
FIG. 1 is a schematic view of a conventional molded cup lid covered onto the rim of a paper cup.
Figure 2:
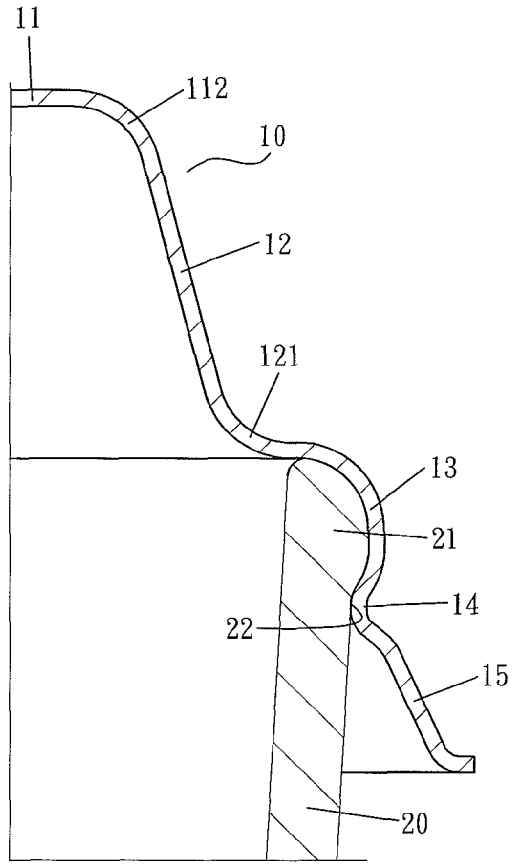
FIG. 2 (PRIOR ART)
FIG. 2 is a partial blowup view of FIG. 1.
Figure 3:
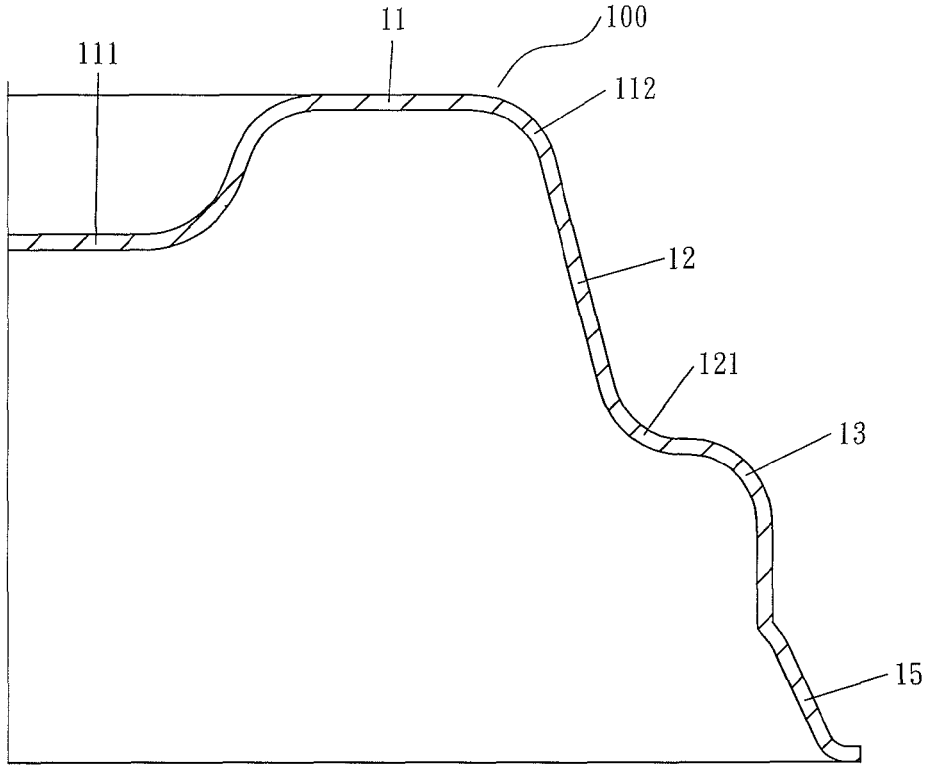
FIG. 3 (PRIOR ART)
FIG. 3 is a partial sectional view of an intermediate product of a conventional molded cup lid.
Figure 6:
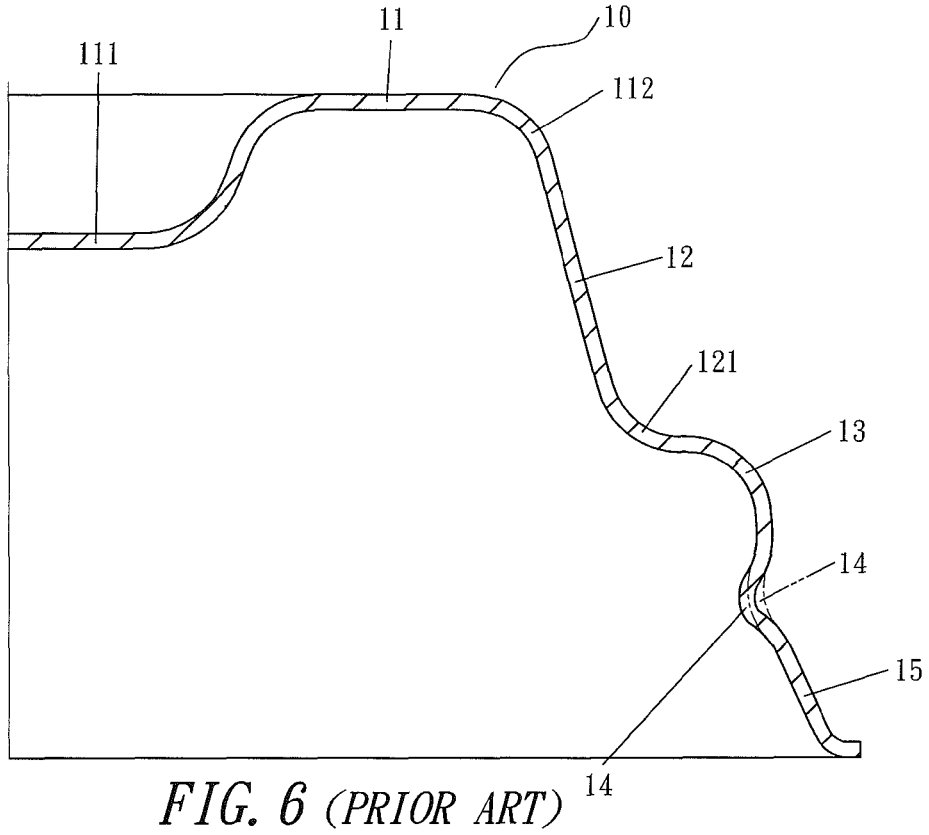
FIG. 6 (PRIOR ART)
FIG. 6 is a schematic view of an inverted-hook groove of a conventional molded cup lid being contracted.
Figure 4:
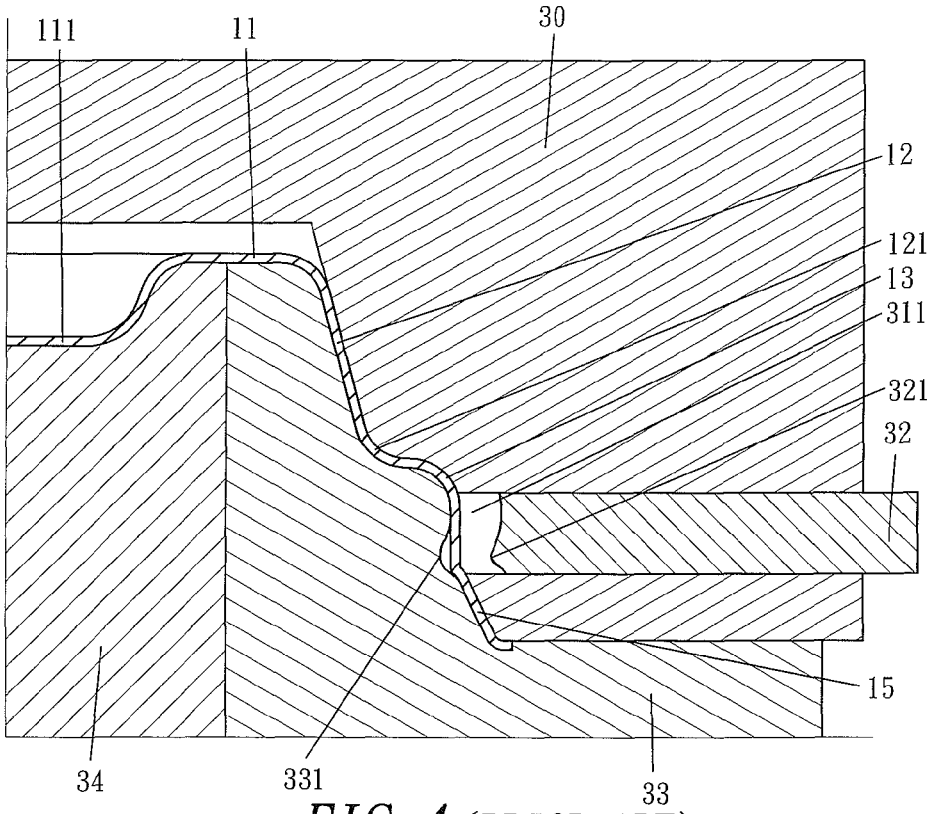
FIG. 4 (PRIOR ART)
FIG. 4 is a schematic view of closing a mold of an intermediate product of a conventional molded cup lid before an inverted-hook groove is manufactured and formed.
Figure 5:
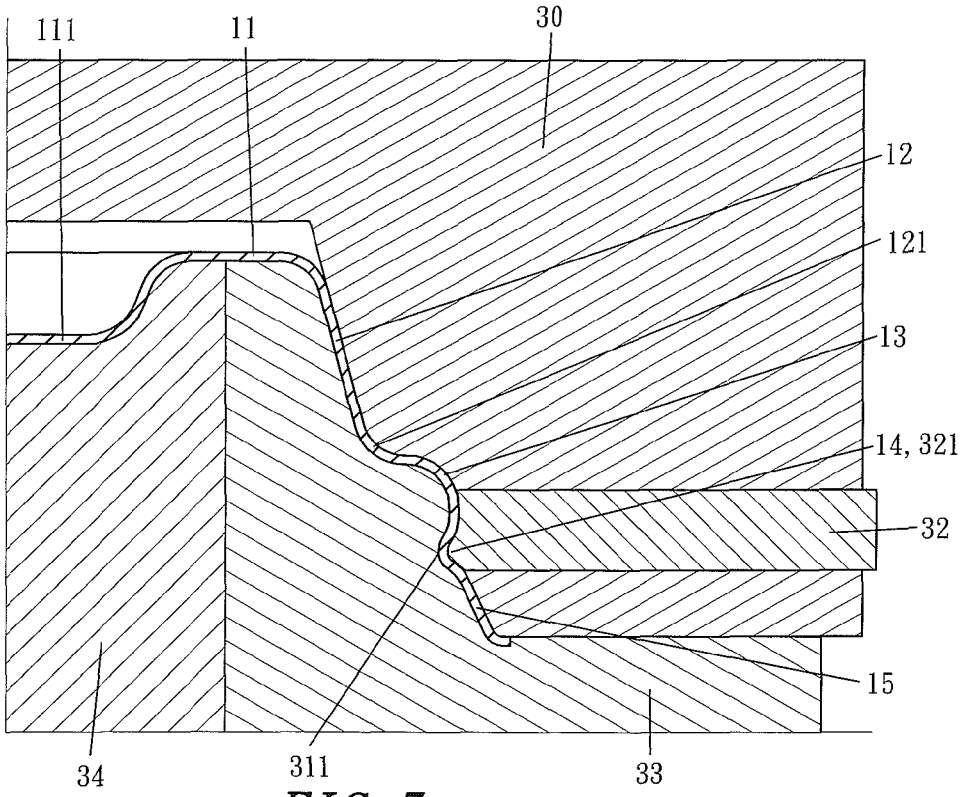
FIG. 5 (PRIOR ART)
FIG. 5 is a schematic view of closing a mold of an intermediate product of a conventional molded cup lid after an inverted-hook groove is manufactured and formed.
Figure 7:
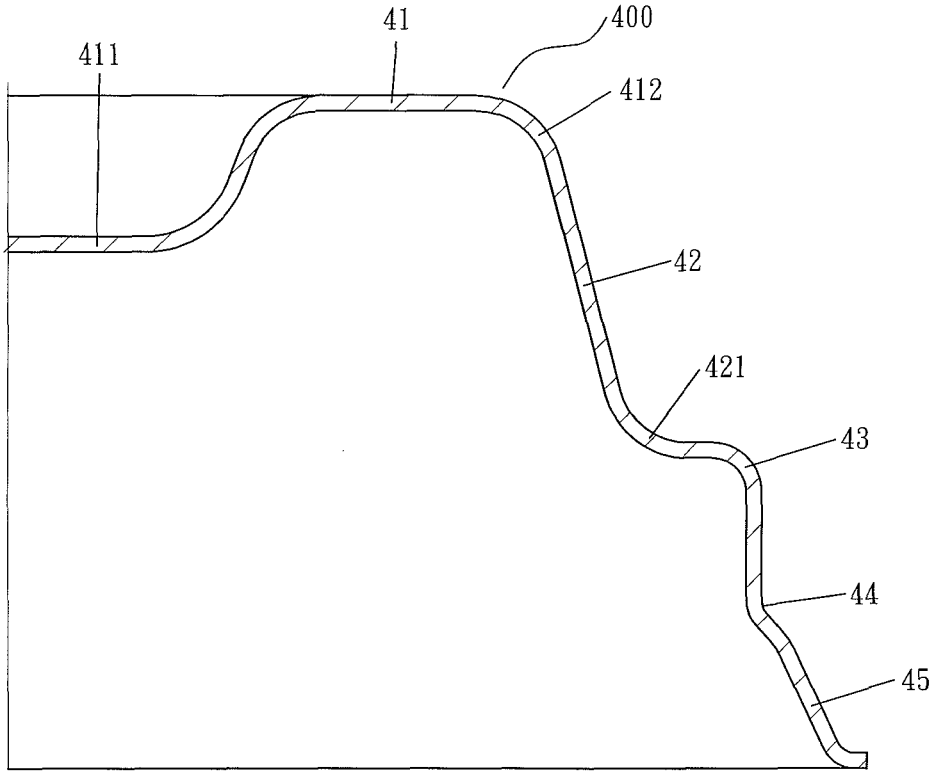
FIG. 7 is a partial sectional view of an intermediate product of a preferred embodiment of the present invention.

The present invention focuses on the process of manufacturing an intermediate product of the molded cup lid, so that an embodiment of the present invention has the existence of an intermediate product 400, and then a complete molded cup lid 40 is manufactured. In FIG. 7, the intermediate product 400 is made of a plant fiber material and manufactured by a pulp suction shaping process and a thermal compression shaping process. Compared with the intermediate product 400 as shown in FIG. 3, the structure of the intermediate product 400 of this embodiment has the same part and different parts, and the same part resides on that both intermediate products 400 have the complete top ring portion 41, cover portion 411, outer arc edge 412, peripheral portion 42, inner arc edge 421 and lift wall 45, and the different parts reside on that an inverted-hook groove 44 is vertically cut and formed from the intermediate product 400 and at a position where the inner arc edge 421 reaches a not-yet formed outer cover edge 43. In other words, the intermediate product 400 has the inverted-hook groove 44 now, but not the outer cover edge 43 yet.

Figure 8:
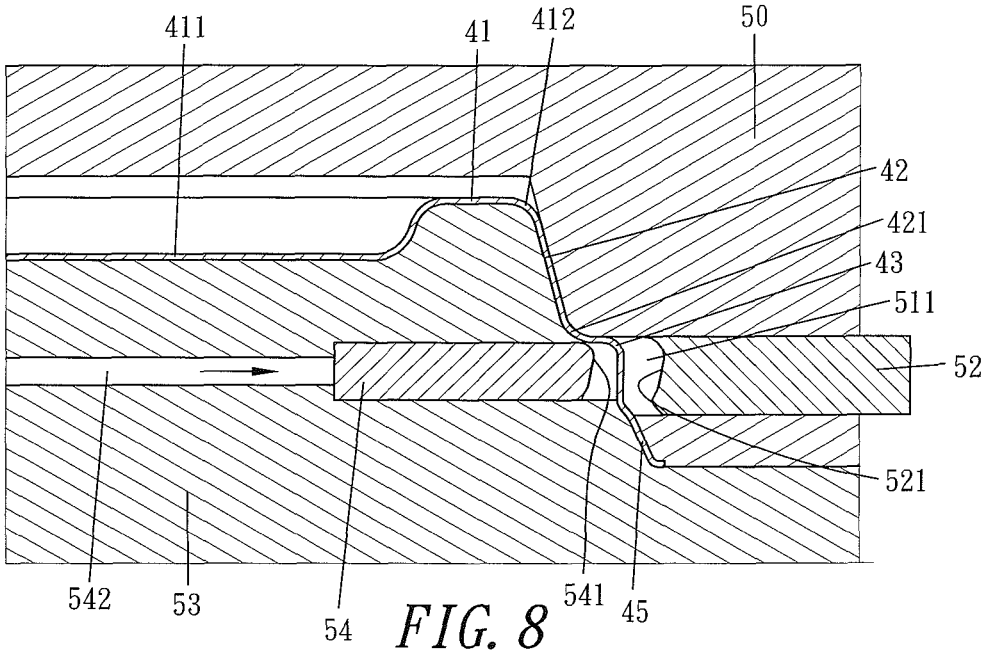
FIG. 8 is a schematic view of closing a mold of a preferred embodiment of the present invention before an outer cover edge is manufactured and formed.
Figure 9:
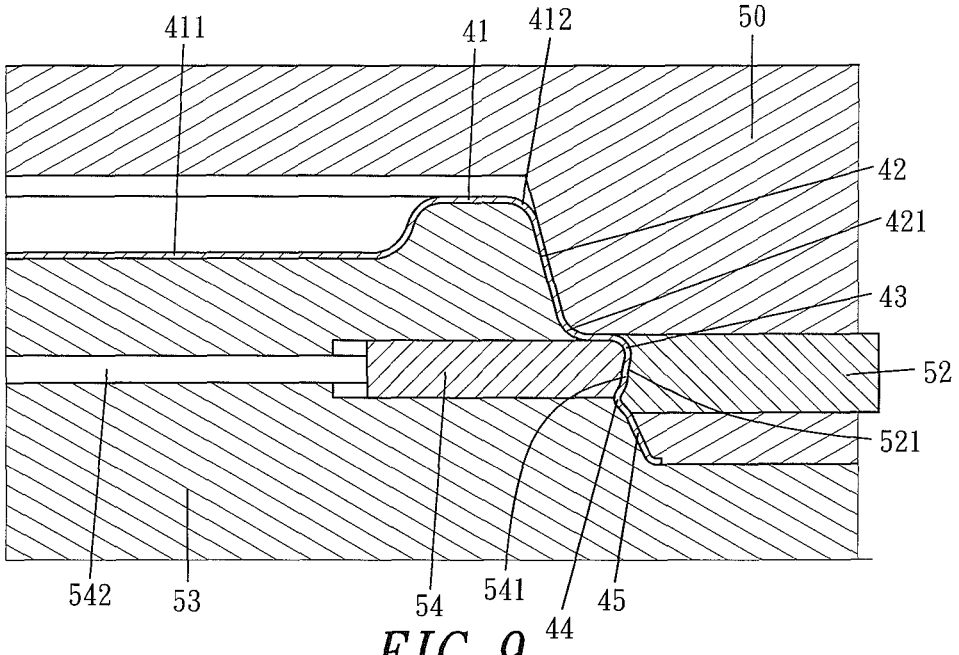
FIG. 9 is a schematic view of closing a mold of a preferred embodiment of the present invention after an outer cover edge is manufactured and formed.

Then, the intermediate product 400 is processed by a compression and deformation process once, and, then, a complete molded cup lid 40 is manufactured. With reference to FIGS. 8 and 9, an outer mold 50 is covered onto the intermediate product 400. The outer mold 50 must match the side profile of the intermediate product 400, and the outer mold 30 has a transversal annular slide groove 511 formed on the intermediate product 400 and at a position where the outer cover edge 43 is pre-formed for receiving the plurality of slide blocks 52. The internal periphery of the slide blocks 52 has a recessed receiving groove 521 (with a profile matching the pre-formed outer cover edge 43). When the slide blocks 52 are moved inwardly forward together, the receiving grooves 521 are combined into an annular body. An inner mold 53 is installed into the intermediate product 400 with a transversally movable shaping mold 54 installed therein, and the inner mold 53 matches the profile of the intermediate product 400. The front end of the shaping mold 54 is formed into a shaping ridge 541 which is corresponsive to the profile of the pre-formed outer cover edge 43. An external power 542, such as a power cylinder, is installed at the rear end of the shaping mold 54 and provided for driving the shaping mold 54 to move forward or backward. The outer mold 50 and the inner mold 53 are closed as shown in FIG. 8.

Figure 10:
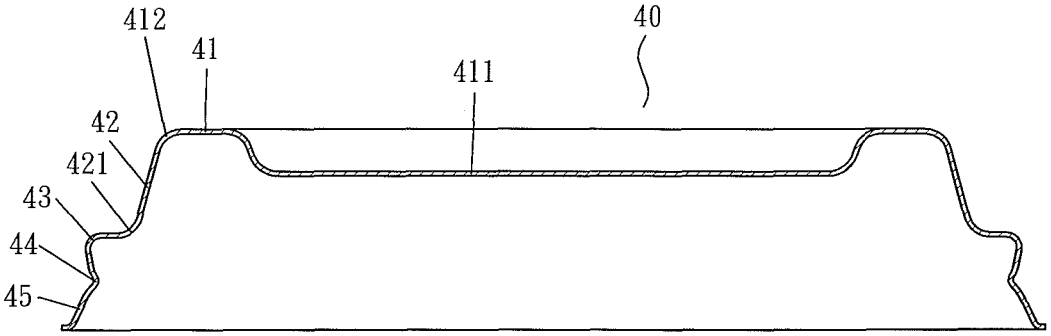
FIG. 10 is a cross-sectional view of a preferred embodiment of the present invention.

The external power pushes the slide blocks 52 to move inward, such that when the receiving groove 521 reaches and stays at the outer side of the intermediate product 400, the top end of the receiving groove 521 abuts a starting-point position of the not-yet formed outer cover edge 43, and the bottom end of the receiving groove 521 abuts the inverted-hook groove 44. Then, the external power 542 is turned on to push the shaping mold 54 to move forward and abut the surface of the intermediate product 400 at the position where the outer cover edge 43 is formed. The shaping mold 54 is continuously moved forward, such that the surface of the intermediate product 400 is compressed by the shaping ridge 541 and deformed to form the profile of an outer cover edge 43 that enters and stays in the receiving groove 521. Now, an external power is provided for producing relative rotation between the inner mold 53 and the shaping mold 54 jointly with the outer mold 50, the slide block 52 and the intermediate product 400. In other words, the inner mold 53 and the shaping mold 54 are rotated together, but the outer mold 50, the slide block 52 and the intermediate product 400 remain still, or the outer mold 50, the slide block 52 and the intermediate product 400 are rotated together, but the inner mold 53 and the shaping mold 54 remain still. Thus, the shaping ridge 541 of the shaping mold 54 is compressed at the inner surface of the intermediate product 400 to form an outer cover edge 43 that enters and remains into the receiving groove 521 as shown in FIG. 9. Finally, the external power 542 is turned on to drive the shaping mold 54 to withdraw to its original position, while driving the slide blocks 52 to withdraw outward. The outer mold 50 and the inner mold 53 are opened in a direction opposite to the direction of closing molds as shown in FIG. 10 to produce the molded cup lid 40.

Figure 11:
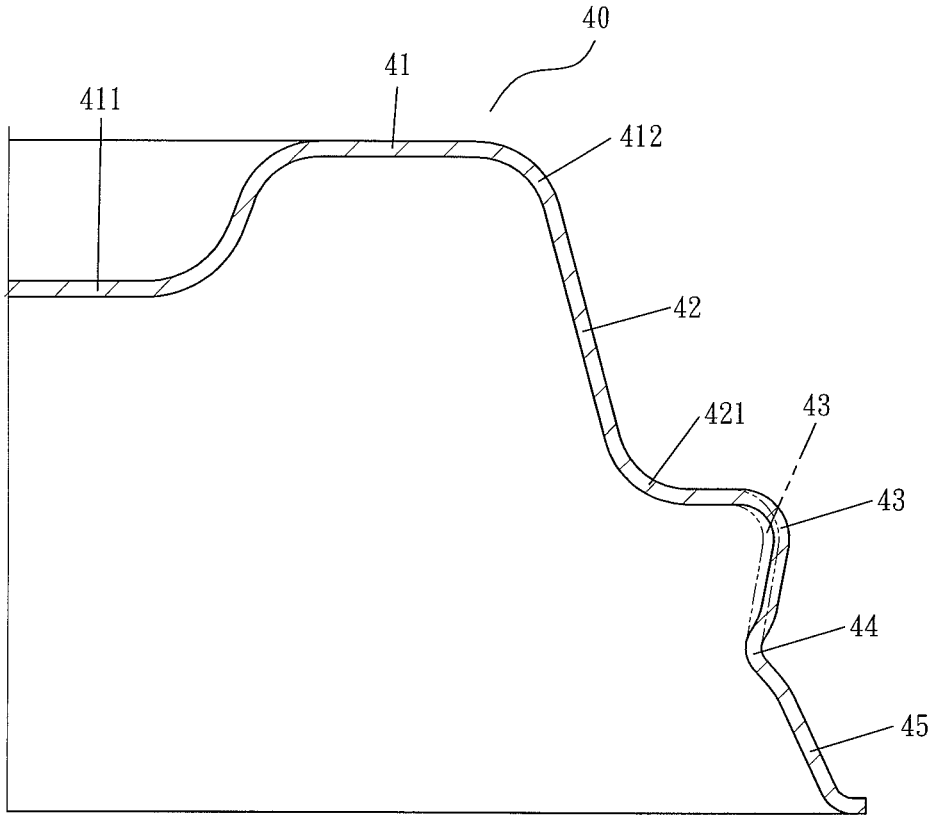
FIG. 11 is a schematic view of an outer cover edge of a preferred embodiment of the present invention being contracted.

In the use of the molded cup lid 40 of the present invention, the molded cup lid 40 has the effects of being covered onto the mouth of the paper cup tightly and preventing leakage of the hot beverage contained in the paper cup. The present invention has the aforementioned effects since the outer cover edge 43 is formed from the inside to the outside by compression. Thus, after the paper cup sits still, the outer cover edge 43 is slightly contracted inward (towards a direction opposite to the compression direction) naturally due to the properties of the plastic material, so that the outer cover edge 43 is reduced as shown in FIG. 11. Since the contraction is very small, the appearance does not show. In addition to the natural contraction of the outer cover edge 43, the inverted-hook groove 44 in the molded cup lid 40 of the present invention is a structure existing when the intermediate product 400 is manufactured by both pulp suction shaping and thermal compression shaping processes, so that the structure and position of the intermediate product 400 have been shaped stably.

When the molded cup lid 40 is used to cover the mouth of the paper cup body 20, the outer cover edge 43 is rotated outwardly to pass across the covered ring 21 of cup body 20 compulsory while applying forces. The hot liquid contained in the cup body 20 pushes the outer cover edge 43 to expand outward, the amount of the natural contraction at the outer cover edge 43 offsets the applied force the drive by heat, together with the stable structure and position of the inverted-hook groove 44, so that after the molded cup lid 40 is covered onto the mouth of the paper cup body 20, the effect of covering the outer cover edge 43 of the molded cup lid 40 onto the covered ring 21 of the paper cup body 20 tightly to prevent the beverage from being leaked or the molded cup lid 40 from being loosened or separated can be achieved. Therefore, the present invention can meet the requirement of covering the molded cup lid 40 to the mouth of the paper cup body 20 tightly.

In summation of the description above, the present invention provides a method of manufacturing an external cover edge of a molded cup lid and a product manufactured by the aforementioned method. An intermediate product of the molded cup lid is made of plant fiber and is manufactured by both "pulp suction shaping" and "thermal compression shaping" processes. A protruding-out outer cover edge is formed around the periphery of the intermediate product.

The method and product of the present invention are novel, and the invention has the effect of preventing leakage and separation since the outer cover edge of the molded cup lid product can wrap around the covered ring of the paper cup body closely, to improve the drawbacks of the prior art.

While the invention has been described by means of specific embodiments, numerous modifications and variations could be made thereto by those skilled in the art without departing from the scope and spirit of the invention set forth in the claims.

What is claimed is:

1. A method of manufacturing an external cover edge of a molded cup lid, with an intermediate product of the molded cup lid made of a plant fiber material being manufactured by a pulp suction shaping process and a thermal compression shaping process, with the method comprising:

(1) covering an outer mold onto the intermediate product, with the outer mold having a side profile matching the intermediate product, with the outer mold having a plurality of slide blocks disposed at a position of the intermediate product where the outer cover edge is formed with the slide blocks being pushed forward to form an annular body, with a receiving groove formed on an inner edge of the slide block and with a profile corresponsive to the outer cover edge for moving the slide blocks forward, to make the receiving groove reach an outer surface of the intermediate product at a position where the outer cover edge is formed;

(2) installing an inner mold into the intermediate product, with the inner mold having a profile matching the profile of the intermediate product, with a transversally movable shaping mold installed in a middle of the inner mold, with the shaping mold having a front end formed into a shaping ridge corresponsive to profile of the pre-formed outer cover edge, with an external power installed at a rear end of the shaping mold for driving the shaping mold to move forward or backward, such that the external power pushes the shaping mold to move forward to an inner surface of the intermediate product at a position where the outer cover edge is pre-formed;

(3) pushing the shaping mold to move continuously forward by the external power, wherein the surface of the intermediate product is compressed by the shaping ridge and deformed to form the profile of the outer cover edge that enters and remains in the receiving groove;

(4) producing relative rotation between the inner mold and the shaping mold jointly with the outer mold, the slide block and the intermediate product, with the shaping ridge of the shaping mold being compressed at the inner surface of the intermediate product and deformed to form an outer cover edge that enters and remains in the receiving groove; and (5) withdrawing the shaping mold to its original position by the external power, wherein while withdrawing the slide block outward, opening the outer mold and the inner mold to produce the molded cup lid.

2. The method of manufacturing an external cover edge of a molded cup lid as claimed in claim 1, wherein the intermediate product of the molded cup lid has a top ring portion with an outer side descended from an outer arc edge and outwardly expanded to form a peripheral portion, and extended outward after reaching an inner arc edge, and wherein an inverted-hook groove is formed at a position vertically below a starting-point position of a not-yet formed outer cover edge, and outwardly deviated to form a lift wall.

3. The method of manufacturing an external cover edge of a molded cup lid as claimed in claim 2, wherein when the slide block is moving forward and wherein the receiving groove reaches the outer surface of the intermediate product at a position where the outer cover edge is pre-formed, the top of the receiving groove abuts the starting-point position of the not-yet formed outer cover edge, and the bottom of the receiving groove abuts the inverted-hook groove.

4. A molded cup lid product manufactured by a method of manufacturing an external cover edge of a molded cup lid, with an intermediate product of the molded cup lid made of a plant fiber material being manufactured by a pulp suction shaping process and a thermal compression shaping process, with the method comprising:

(1) covering an outer mold onto the intermediate product, with the outer mold having a side profile matching the intermediate product, with the outer mold having a plurality of slide blocks disposed at a position of the intermediate product where the outer cover edge is formed, with the slide blocks being pushed forward to form an annular body, with a receiving groove formed on an inner edge of the slide block and with a profile corresponsive to the outer cover edge for moving the slide blocks forward, to make the receiving groove reach an outer surface of the intermediate product at a position where the outer cover edge is formed;

(2) installing an inner mold into the intermediate product, with the inner mold having a profile matching the profile of the intermediate product, with a transversally movable shaping mold installed in a middle of the inner mold, with the shaping mold having a front end formed into a shaping ridge corresponsive to profile of the pre-formed outer cover edge, with an external power installed at a rear end of the shaping mold for driving the shaping mold to move forward or backward, such that the external power pushes the shaping mold to move forward to an inner surface of the intermediate product at a position where the outer cover edge is pre-formed;

(3) pushing the shaping mold to move continuously forward by the external power, wherein the surface of the intermediate product is compressed by the shaping ridge and deformed to form the profile of the outer cover edge that enters and remains in the receiving groove;

(4) producing relative rotation between the inner mold and the shaping mold jointly with the outer mold, the slide block and the intermediate product, with the shaping ridge of the shaping mold compressed at the inner surface of the intermediate product to form an outer cover edge that enters and remains in the receiving groove; and (5) withdrawing the shaping mold to an original position by the external power, wherein while withdrawing the slide block outward, opening the outer mold and the inner mold to produce the molded cup lid.

5. The molded cup lid product of claim 4, wherein the intermediate product of the molded cup lid has a top ring portion with an outer side descended from an outer arc edge and expanded outward to form a peripheral portion, and extended outwardly after reaching an inner arc edge, and wherein an inverted-hook groove is formed at a position vertically below a starting-point position of a not-yet formed outer cover edge, and outwardly deviated to form a lift wall.

6. The molded cup lid product of claim 5, wherein when the slide block is moving forward and when the receiving groove reaches the outer surface of the intermediate product at a position where the outer cover edge is pre-formed, the top of the receiving groove abuts the starting-point position of the not-yet formed outer cover edge, and the bottom of the receiving groove abuts the inverted-hook groove.

* * * * *